US005666729A

United States Patent [19]

Ferraro

[11] Patent Number: 5,666,729

[45] Date of Patent: Sep. 16, 1997

[54] SUSPENDED BLADE SHAVING SYSTEM

[75] Inventor: Frank A. Ferraro, Trumbull, Conn.

[73] Assignee: Warner-Lambert Company, Morris Plains, N.J.

[21] Appl. No.: 419,216

[22] Filed: Apr. 10, 1995

[51] Int. Cl.[6] ..... B26B 21/02

[52] U.S. Cl. ..... 30/50; 30/346.57

[58] Field of Search ..... 30/47–50, 346.5, 30/346.57

[56] References Cited

U.S. PATENT DOCUMENTS

| | | | |
|---|---|---|---|
| 4,461,079 | 7/1984 | Ciaffone et al. . | |
| 5,347,714 | 9/1994 | Prolchaska | 30/50 X |
| 5,416,974 | 5/1995 | Wain | 30/50 |

FOREIGN PATENT DOCUMENTS

| | | |
|---|---|---|
| 0045879 | 2/1982 | European Pat. Off. . |
| 0416233 | 3/1991 | European Pat. Off. . |
| 2379357 | 9/1978 | France . |
| 2406504 | 5/1979 | France . |
| 2457155 | 12/1980 | France . |

*Primary Examiner*—Douglas D. Watts
*Attorney, Agent, or Firm*—Charles W. Almer

[57] ABSTRACT

Shaving systems having a first support, at least one, and preferably a plurality, of resilient supports, and a plurality of skin-engaging elements movably arranged in spaced relation and supported by the resilient support. The resilient supports normally maintain the movable skin-engaging elements, e.g. blades and/or cap member, in spaced relation such that the movable, skin-engaging elements are spaced by a first distance, relative to each other, when the skin-engaging elements are in a normal, unbiased position. In one embodiment, when one or more of the skin-engaging elements is acted upon by forces normally encountered during shaving, the resilient supports yield in order to move each of the blades and the cap into a less aggressive, compressed position wherein the spacing between neighboring skin-engaging elements is reduced.

39 Claims, 5 Drawing Sheets

SUSPENDED BLADE SHAVING SYSTEM

The present invention is directed to a shaving system and, more particularly, to a shaving system having at least one and preferably a plurality of movable skin-engaging elements.

BACKGROUND OF THE INVENTION

Relatively recent advances in shaving systems have included a variety of dynamic razors wherein one or more of a guard member, seat blade, and cap blade, move in response to forces encountered during shaving. Various systems which have been disclosed change the shaving angle of one or more of the blades, the span and/or the blade exposure in response to shaving forces.

One such system described in U.S. Pat. No. 4,586,255 to Jacobson comprises a movable guardbar, and two movable blades, all of which are spring loaded in a supporting structure for movement in response to forces encountered during shaving. The sharpened blades are welded to blade supports which contact upwardly biased leaf springs. The movable guard member and blades are maintained within the supporting structure by metal bands which wrap around the ends of the cartridge. When the movable blades encounter forces during shaving, the blades are urged downwardly into the support structure to less aggressive shaving positions in order to minimize the risk of causing nicks and cuts. In light of the welding steps and the number of separate pieces which must be assembled during the manufacture of this cartridge, it would be desirable to provide a dynamic shaving system which can be manufactured quickly and at relatively low cost.

Since the skin-engaging elements of the aforementioned system move independently, forces exerted on one skin-engaging element will not cause other skin-engaging elements to take less aggressive positions. It would therefore also be desirable to provide a shaving system wherein the position of more than one skin-engaging element will be changed by movement of a single skin-engaging element.

It would also be desirable to provide a shaving system which provides a safer shave than a conventional two-blade cartridge.

These and other advantages are described below.

SUMMARY OF THE INVENTION

The various embodiments of the present invention comprise shaving systems having at least one, and preferably a plurality of, resilient supports, and a plurality of blades movably arranged in spaced relation and supported by the resilient support.

One preferred embodiment of the present invention comprises a razor head having a support base and rigid side walls. A plurality of resilient supports are disposed in spaced offset relation and are integrally molded with the support base. The supports contact three movable blades and a movable cap member. The resilient supports normally maintain the movable blades and cap member in spaced relation such that the movable, skin-engaging elements are spaced by a first distance, relative to each other, when the skin-engaging elements are in a normal, unbiased position. When one or more of the skin-engaging elements is acted upon by forces encountered during shaving, the resilient supports yield in order to move each of the blades and the cap into a less aggressive, compressed position wherein the spacing between neighboring skin-engaging elements is reduced and the blades are moved downwardly into the space between the side walls. According to this preferred embodiment of the present invention, the blades are maintained in a substantially parallel relation when the shaving system is in its "normal" unbiased position, as well as when the skin-engaging elements are in a compressed configuration.

The provision of three blades is designed to increase the efficiency of the shave provided by one preferred embodiment of the present invention. Other embodiments comprise fewer blades, while still other embodiments comprise a fixed cap member.

These and other embodiments are described in greater detail below with reference to the figures.

DETAILED DESCRIPTION

The illustrated embodiment of the present invention is a shaving system in the form of a razor head comprising a support base with integrally molded, resilient supports which movably connect three sharpened blades and a movable cap member to the support base. While the present invention is illustrated in the form of a disposable cartridge, the advantages of the present invention are equally applicable to other razor heads and shaving systems. As used herein, the term "razor head" is meant to include cartridges which are designed and manufactured for attachment to a separate razor, as well as the operative portion of a disposable razor wherein the skin-engaging portions are integrally formed with a handle section.

Figure 1:
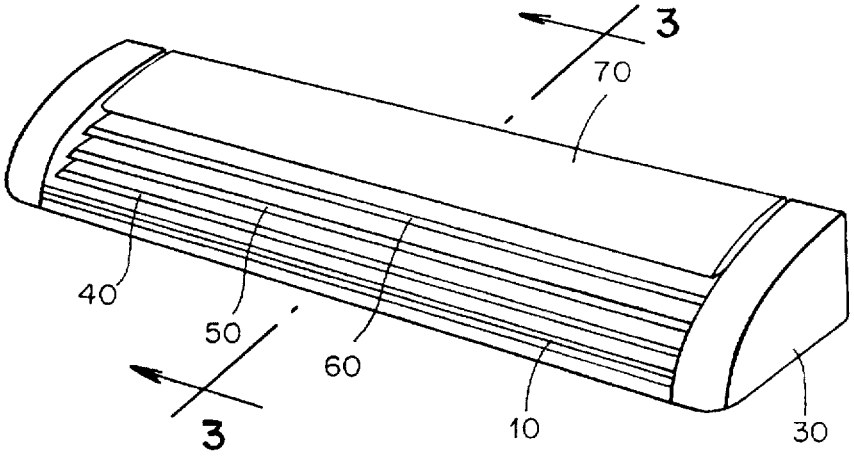
FIG. 1 is a top, perspective view of one embodiment of the present invention.
Figure 3:
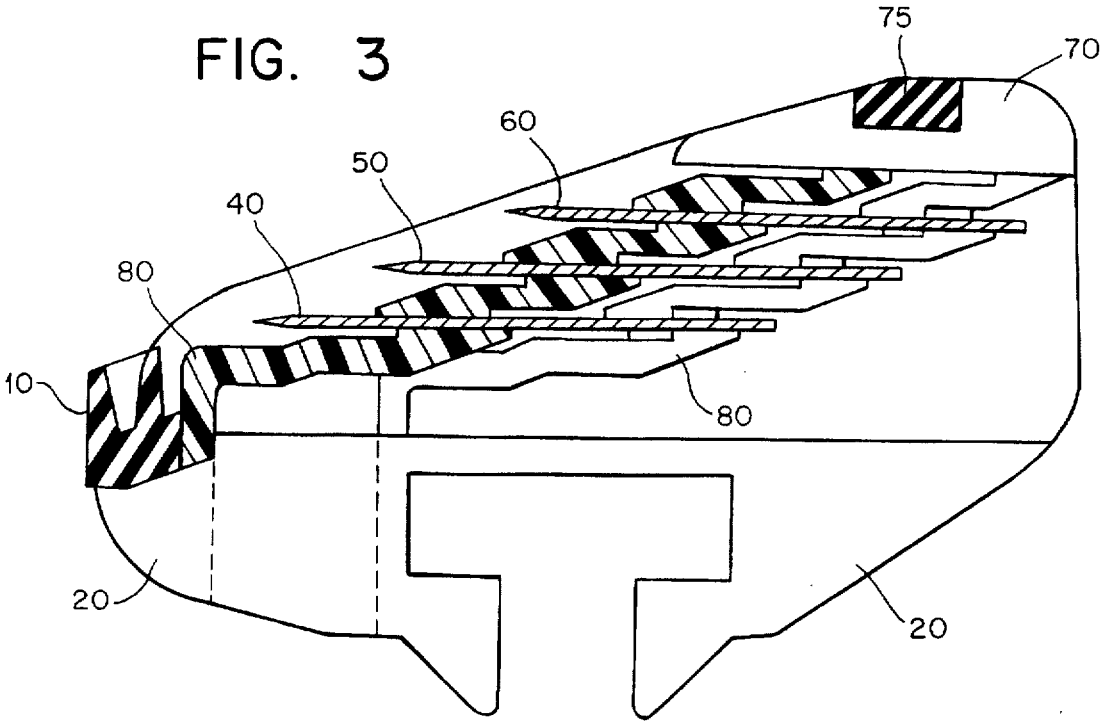
FIG. 3 is a cross-sectional view taken along lines 3—3 of FIG. 1.

The razor head illustrated in the Figures comprises a resilient face-engaging surface 10 connected to a support base 20 having fixed side walls 30. A seat blade 40, middle blade 50, cap blade 60 and cap 70 are movably supported by support members 80 as best shown in FIG. 3. According to this preferred embodiment of the present invention, support members 80 are integrally molded with base 20. The support members are advantageously molded around and through holes in each of the blades in order to securely connect the blades with the base 20 and each other. The upper ends of the support members 80 are also integrally molded to movable cap 70 in this preferred embodiment. A lower portion of at least one of the support members acts as a guard surface.

Figure 2:
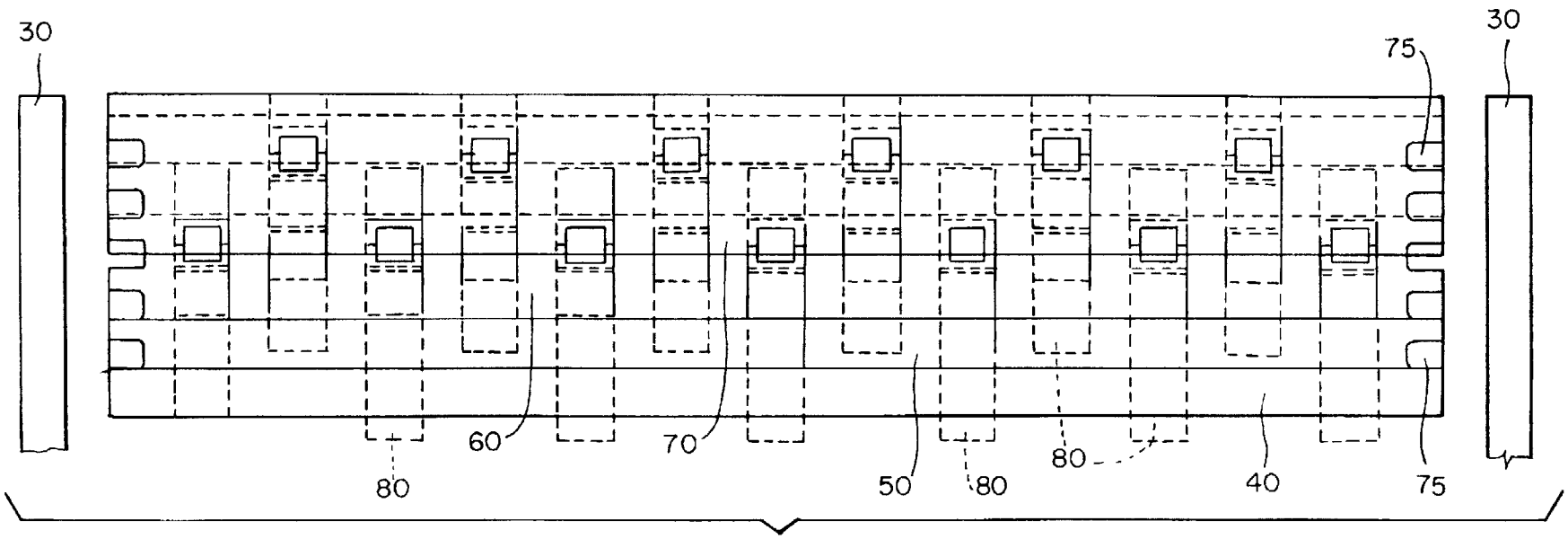
FIG. 2 is a partial, top view illustrating the relative positioning of the blades and supports of the razor head shown in FIG. 1.

While the number of resilient supports can be varied without departing from the scope of the present invention, as shown in FIG. 2 the illustrated embodiment has 13 resilient supports. Adjacent resilient supports 80 are disposed in offset relation such that a forwardly disposed resilient support 80 will be positioned next to rearwardly disposed resilient supports. This offset positioning of resilient supports 80 is advantageously designed to increase the stability of the skin-engaging elements and also to provide greater flexibility in design as described below. In order to facilitate assembly of the blades within the cavity of a mold for insert molding, the blades are advantageously provided with positioning notches 75 in the sides thereof. The present invention is particularly suited to be manufactured by an insert molding process. As used herein, the term "insert molding" is used to indicate a molding operation wherein the product which leaves the mold is a final product and does not require further assembly.

Figure 4:
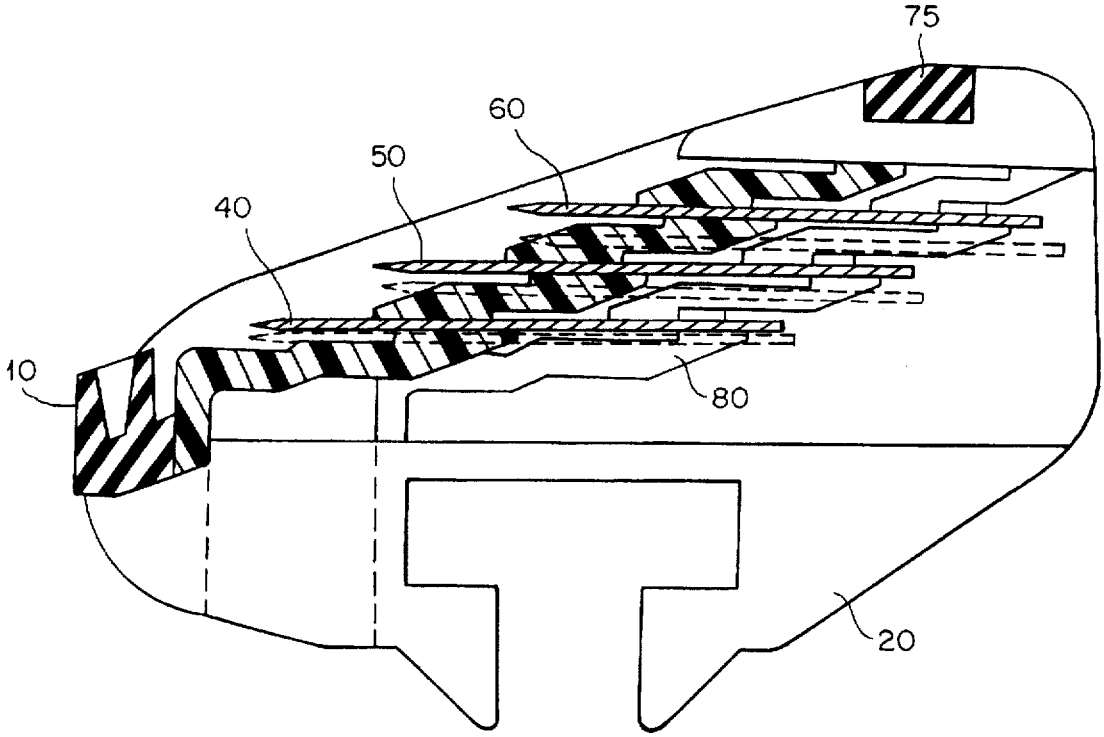
FIG. 4 is a cross-sectional view illustrating the unbiased position and a biased position (in phantom) of the skin-engaging elements of one embodiment.

The dynamic aspects of the present invention are provided by support members 80 which have sufficient inherent resiliency to allow the blades and cap member 70 to move downwardly relative to side walls 30, i.e. toward base 20, in response to forces encountered during shaving. The support members 80 also return these skin-engaging elements to their "normal" unbiased position when the shaving forces are removed. FIG. 4 illustrates the positions of the blades and cap member when in a "normal" unbiased position in solid lines and one position of the blades and cap member 70 when acted upon forces encountered during shaving. The unique dynamics of the present invention can be appreciated best from FIG. 4 wherein it is also illustrated that the vertical spacing between the blades decreases and the entire skin-engaging package, including the blades and cap member, is effectively compressed toward base 20 in response to shaving forces. Furthermore, since side walls 30 of this illustrated embodiment are fixed relative to base 20, the relative downward movement of the blades and cap 70 will tend to reduce the exposure of the portions of the cutting edges proximate side walls 30. From FIG. 4, it will also be appreciated that forces exerted on any one of the blades or cap member 70 will result in movement of each of the other movable, skin-engaging elements.

It will also be appreciated that in the illustrated embodiment the upper skin-engaging elements will move more than the lower, skin-engaging elements. For example, cap blade 60 will tend to move a greater distance than seat blade 40 due to their relative distances from the attachments between the support members 80 and base member 20.

Figure 5:
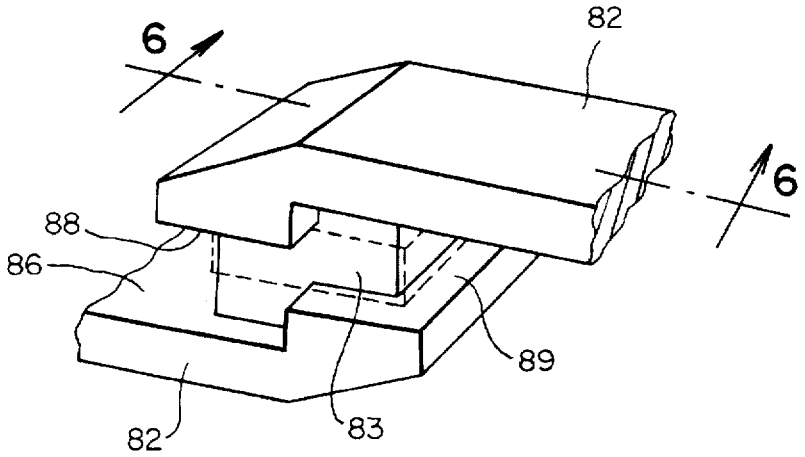
FIG. 5 is a partial, perspective view of a resilient support of a preferred embodiment of the present invention.
Figure 6:
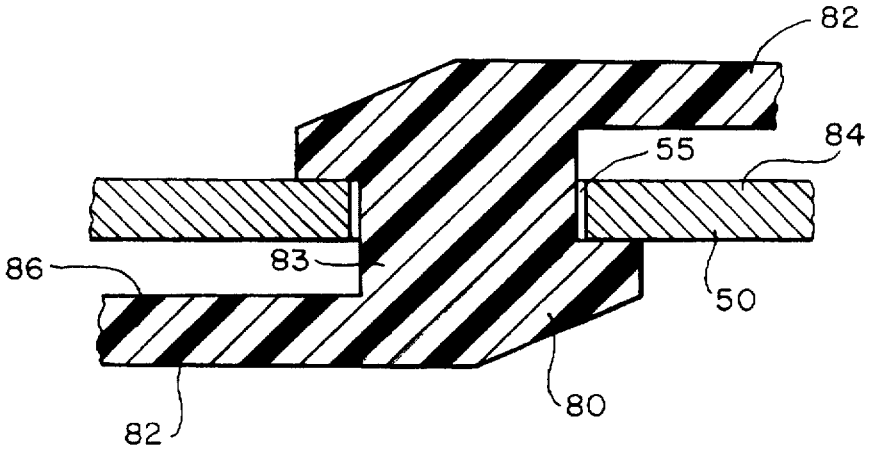
FIG. 6 is a cross-sectional view taken along line 6—6 of FIG. 5 with portions of a blade added.
Figure 7:
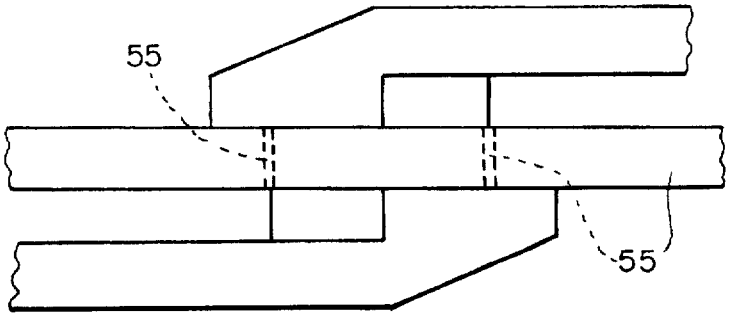
FIG. 7 is a side view of the portions of resilient support and blade shown in FIG. 6.
Figure 9A:
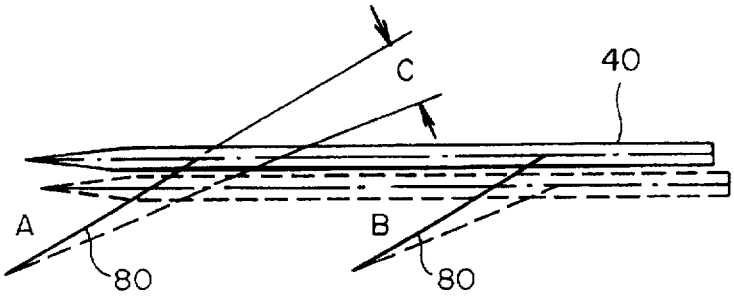
FIGS. 9A–9D are schematic illustrations of several embodiments of the present invention.
Figure 9B:
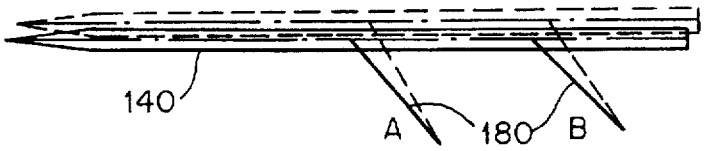
Figure 9C:
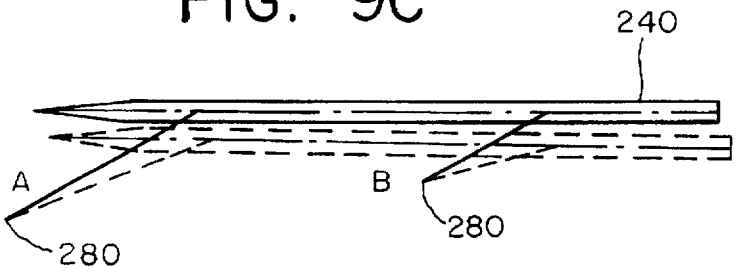
Figure 9D:
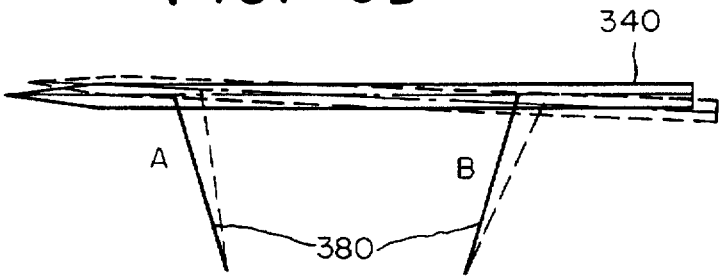

FIGS. 5–7 illustrate one preferred manner of connecting a resilient support member 80 to a blade 50. As shown, each of the illustrated support members 80 comprise upper and lower generally horizontal sections 82 which are connected by vertical portions 83. The vertical portions 83 extend through holes in each of the blades, such as holes 55 in blade 50. Upper, inner surface 84 of resilient support 80 which is positioned above and rearwardly of hole 55 is normally spaced from blade 50 as is lower, inner surface 86 which is disposed forwardly and below blade hole 55. Upper retention surface 88 and lower retention surface 89 extend laterally beyond the peripheral borders of hole 55 above and below, respectively, blade 50. These retention surfaces of resilient support 80 contact the blade to keep the blade in position while allowing the blade to retain its generally horizontal configuration when the skin-engaging portions move in response to forces encountered during shaving.

From the present description, it will be appreciated that forces exerted on the movable skin-engaging elements during shaving will cause these movable elements to move along an arc. The angle and radius of the arc will be determined by the length of the effective radius which is related to the distance between the movable elements and the base of the resilient support member. In the illustrated embodiment, shaving forces reduce the blade angle, blade exposure and vertical distance between the blade and the base thereby providing a smoother and safer shave.

According to alternative embodiments of the present invention, the length and positioning of the resilient support members can be modified to provide a different predetermined action such as unparallel blade movement, increasing the aggressiveness of the shaving geometry, or decreasing the aggressiveness of the shaving geometry in response to forces encountered during shaving. While in the illustrated embodiment the resilient support members 80 have the same length and all angle upwardly and rearwardly, it is also possible to provide resilient supports having different lengths. For example, if the length of a rearward resilient support is shorter than a forward resilient support, the shaving angle will tend to decrease in response to shaving forces. Furthermore, if the resilient support members are disposed in alignment, they can be formed with different lengths in order to dispose one or more of the blades in a relation other than parallel. For example, by forming the supports with different lengths, it is possible to move the vertical positioning of a single blade more on one side than on the other side.

It is also within the scope of the present invention to connect a resilient support to another portion of the supporting structure of the razor head. Thus, while the resilient supports of the embodiment illustrated in FIGS. 1–4 are connected to the lower base of the support structure, it is also within the scope of the present invention to connect the resilient supports to a fixed cap member, rear walls or side walls. In each such instance, those skilled in the art will appreciate that the movement of the blades would not necessarily move in the same manner as the blades shown in FIGS. 1–4 in response to shaving forces. In this regard the blade movement would not necessarily be downward, i.e. toward the base.

Figure 8:
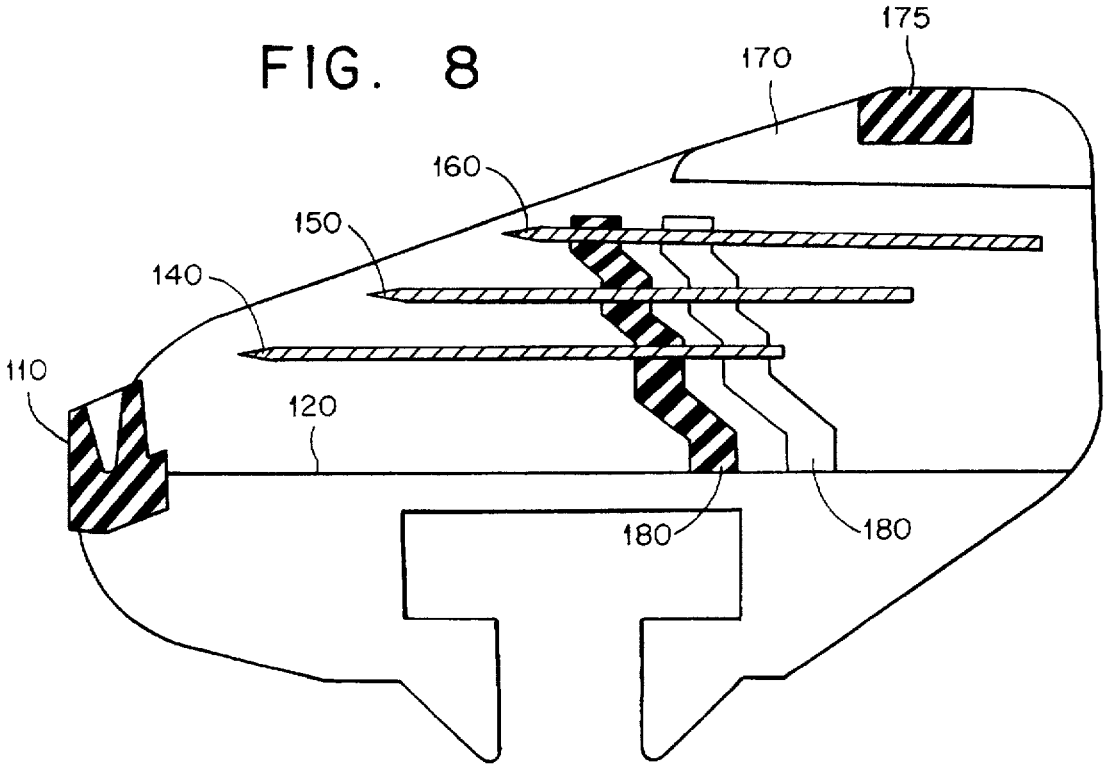
FIG. 8 is a cross-sectional view of an alternative embodiment of the present invention.

FIG. 8 illustrates an alternative embodiment of the present invention wherein resilient supports 180 are angled forwardly from base 120. According to this alternative embodiment, the vertical distance between the blades will increase in response to forces exerted during shaving. Furthermore, according to this embodiment of the present invention cap 170 is not connected to the support members, but is maintained in fixed relation to the base 120.

FIG. 9 contains partial schematics of several alternatives of the present invention. While only one blade is shown in each schematic, the represented embodiments will typically comprise several movable skin-engaging components. FIG. 9A generally illustrates the blade movement of the embodiment illustrated in FIGS. 1–4. In FIG. 9B the blade supports are angled forwardly such that movement of a skin-engaging member such as a blade will increase the vertical spacing between the movable skin-engaging members. The schematic of FIG. 9C illustrates another embodiment wherein the blade supports have unequal lengths and thereby result in a change in the blade angle upon movement in response to forces encountered during shaving. A still further embodiment is illustrated in FIG. 9D wherein the blade supports are positioned in a divergent angle. According to this illustrated embodiment, the forward portion of the blade will move upwardly while the rearward portion of the blade will move downwardly in response to forces encountered during shaving. This embodiment also provides a change in the blade angle when the blade moves during shaving.

According to an alternative embodiment of the present invention, two skin-engaging elements in the form of a blade and a cap member are resiliently supported by at least one resilient support member. Thus, the advantages of the present invention may also be realized with a single blade shaving system. It is also within the scope of the present invention to have one or more of the skin-engaging elements in the form of an unsharpened blade.

Furthermore, it will be appreciated that the skin-engaging members of the illustrated embodiment of the present invention move an amount proportionate to the force acting upon them. The present invention thereby advantageously provides precise coordination between the movement of each of the blades and the cap member 70 as a function of shaving forces applied.

Unlike the dynamic system disclosed in the Jacobson patent referenced above in which all movable skin-engaging elements move independently, the illustrated embodiments of the present invention control the shaving geometry, namely the shave angles and blade spans. The present invention thereby provides control over these movable elements in a predictable manner so that a predetermined geometry will be maintained during the dynamics of shaving. Particularly, in the embodiment illustrated in FIGS. 1 to 7, shaving forces cause increasingly lower shave angles and increasingly greater spans which are designed to provide the safety and comfort of a dynamic safety razor while maintaining desired closeness.

While the advantages of the present invention may be achieved with only a conventional, substantially rigid guard bar preceding the blade edges, the illustrated embodiment comprises a resilient skin-engaging material 10 having a higher coefficient of friction with wet skin than a rigid plastic of the type commonly used with disposable cartridges. The illustrated resilient material comprises a rubber-like texture and is connected to support base 20. The resilient material 10 is preferably connected to a rigid support base 20, formed for example, of polypropylene, in a sequential molding process. The resilient material 10 may comprise, for example, suitable corrosion-resistant, resilient materials such as Hercuprene 1000, 3000 series, Durometer 30 to 90 A scale available from J-Von, Leominster, Mass.; Kraton G series, Durometer 30 to 90 A scale available from Shell Chemical Co., Lisle, Ill.; and Santoprene 2271 series, Durometer 30 to 90 A scale available from Monsanto, Co. According to one preferred embodiment, a resilient material having a higher coefficient of friction with wet skin than a rigid plastic is also disposed on the upper, skin-engaging portions of sidewalls 30.

According to a still further embodiment of the present invention, at least one of said blades further comprises a fencing element such as the type disclosed in U.S. Pat. Nos. 1,035,548, 3,263,330, 3,505,734, 3,750,285 and 4,122,006, which are hereby incorporated by reference.

While the illustrated embodiment comprises a plurality of blades and a movable cap supported by a plurality of resilient support members, advantages of the present invention may also be realized with a fixed cap member, movable side walls, and/or with less than the illustrated number of blades. Furthermore, while a plurality of resilient support members are preferred, it is also possible to utilize a single resilient support with one or more blades or to use one or more resilient supports within a single blade system.

Another preferred aspect of the present invention comprises the incorporation of a shaving aid on one or more of the skin-engaging surfaces of the shaving system.

As disclosed in U.S. Pat. No. 4,170,821 to Booth, which is hereby incorporated by reference, a shaving aid may comprise one or various combinations of the following:

A. A lubricating agent for reducing the frictional forces between the razor and the skin, e.g., a micro-encapsulated silicone oil.

B. An agent which reduces the drag between the razor parts and the shaver's face, e.g., a polyethylene oxide in the range of molecular weights between 100,000 and 6,000,000; a non-ionic polyacrylamide; and/or a natural polysaccharide derived from plant materials such as "guar gum".

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicon polyethylene oxide block copolymer and detergent such as sodium lauryl sulphate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts.

Alternatively, the shaving aid may comprise on& or more of the shaving aids disclosed in U.S. Pat. No. 5,056,221 to Thoene, U.S. Pat. No. 4,044,120 to Rowsell et al., U.S. Pat. No. 5,095,619 to Davis et al, or Japanese Patent Application No. Hei 7 [1995]-24156 to Miyazaki, et al. which are also hereby incorporated by reference.

The razor heads of the present invention can be formed utilizing a wide range of engineering materials for both skin-engaging and non-skin-engaging elements, in order to create a variety of sensory stimulations that will effect the user's perception of the shave.

What is claimed is:

1. A razor head comprising:

a first support;

at least one resilient second support member connected to said first support;

a first skin-engaging element connected to and movably supported by said resilient support member;

a second skin-engaging element movably connected to said first skin-engaging element for movement relative to said first skin-engaging element; and side walls extending upwardly from said first support;

wherein said side walls comprise at least one resilient material which yields in response to forces encountered during shaving.

2. A razor head according to claim 1 wherein said resilient support member contacts at least two of said skin-engaging elements.

3. A razor head according to claim 1 wherein said resilient support member contacts at least two blades.

4. A razor head comprising:

a first support;

at least one resilient second support member connected to said first support;

a first skin-engaging element connected to and movably supported by said resilient support member; and a cap member movably supported by said support member.

5. A razor head according to claim 4 wherein said cap member is integrally formed with said support member.

6. A razor head according to claim 4 comprising a plurality of resilient support members which extended through openings in at least one of said skin-engaging elements.

7. A razor head according to claim 1 wherein said resilient support member is integrally formed with said first support.

8. A razor head according to claim 1 wherein said resilient support member extends upwardly from said first support.

9. A razor head according to claim 8 wherein said resilient support member also extends rearwardly from said first support.

10. A razor head according to claim 8 wherein said resilient support member also extends forwardly from said first support.

11. A razor head according to claim 1 further comprising side walls extending upwardly from said first support.

12. A razor head according to claim 1 further comprising a resilient guard member.

13. A razor head according to claim 1 comprising at least three blades.

14. A razor head according to claim 1 comprising a plurality of resilient support members wherein a length of a first resilient support member between a first skin-engaging element and said first support is different from a length of a second resilient support member between said first skin-engaging element and said first support.

15. A razor head according to claim 1 comprising a plurality of support members wherein a length of a first resilient support member between a first skin-engaging element and said second skin-engaging element is different from a length of a second resilient support member between said first skin-engaging element and said second skin-engaging element.

16. A razor head according to claim 1 wherein at least one of said skin-engaging members is an unsharpened blade.

17. A razor head according to claim 1 comprising at least three skin-engaging members wherein skin-engaging surfaces of at least two of said skin-engaging elements comprise materials which are different from each other.

18. A razor head according to claim 1 wherein said resilient support member and said first support comprise materials which are different from each other.

19. A razor head according to claim 1 wherein said first skin-engaging element is a blade and said second skin-engaging element is a blade.

20. A razor head according to claim 1 wherein said first skin-engaging element is a blade and said second skin-engaging element is a cap member.

21. A razor head according to claim 1 further comprising a third skin-engaging element movably connected to at least one of said first or said second skin-engaging element.

22. A razor head comprising:

a first support;

a resilient second support member connected to said first support;

a first skin engaging member comprising a first side and a second side;

a second skin engaging element;

said resilient second support member extending from said first support to said first side of said first skin-engaging element and said second skin-engaging element movably connected to said second side of said first skin-engaging element.

23. A razor head according to claim 22 wherein said first side of said first skin-engaging element is generally opposite said second side.

24. A razor head according to claim 22 wherein said resilient second support member extends substantially continuously from said first support to said second skin-engaging element.

25. A razor head according to claim 1 wherein said second skin-engaging element moves a greater distance than said first skin-engaging element in response to forces encountered during shaving.

26. A razor head according to claim 1 wherein at least one of said skin-engaging elements moves along an arc in response to forces encountered during shaving.

27. A razor head according to claim 1 wherein said second skin-engaging element moves relative to said first skin-engaging element more than said first skin-engaging element moves relative to said first support.

28. A razor head according to claim 12, wherein said first skin-engaging element is a guard member.

29. A razor head according to claim 21, wherein said first, second and third skin-engaging elements are blades.

30. A razor head according to claim 29, wherein at least one of said skin-engaging members is an unsharpened blade.

31. A razor head according to claim 21, wherein said third skin-engaging element is a cap member.

32. A razor head according to claim 22 comprising at least three blades.

33. A razor head according to claim 22 further comprising a third skin-engaging element movably connected to at least one of said first or second skin-engaging elements.

34. A razor head according to claim 32, wherein said first, second and third skin-engaging elements are blades.

35. A razor head according to claim 33, wherein at least one of said blades is an unsharpened blade.

36. A razor head according to claim 22, wherein said first skin engaging member is a guard member.

37. A razor head according to claim 22, wherein said third skin engaging member is a cap member.

38. A razor head according to claim 33, wherein said first skin-engaging member is a guard member.

39. A razor head according to claim 33, wherein said third skin-engaging member is a cap member.

* * * * *